US007581661B2

(12) United States Patent
Thomas

(10) Patent No.: US 7,581,661 B2
(45) Date of Patent: Sep. 1, 2009

(54) MULTIPURPOSE TOOTH PASTE DISPENSER

(76) Inventor: Joshua J. Thomas, P.O. Box 355, Massapequa Park, NY (US) 11762

( * ) Notice: Subject to any disclaimer, the term of this patent is extended or adjusted under 35 U.S.C. 154(b) by 505 days.

(21) Appl. No.: 11/418,282

(22) Filed: May 4, 2006

(65) Prior Publication Data

US 2007/0257056 A1 Nov. 8, 2007

(51) Int. Cl.
*B65D 35/28* (2006.01)

(52) U.S. Cl. ..... 222/103; 222/96; 222/102; 222/105

(58) Field of Classification Search ..... 222/96, 222/101–102, 105, 107, 325–326, 386, 103
See application file for complete search history.

(56) References Cited

U.S. PATENT DOCUMENTS 2,496,004 A * 1/1950 Eula ..... 222/102
3,675,822 A 7/1972 Casali et al.
3,738,533 A 6/1973 Bertrand
4,019,655 A * 4/1977 Moeller ..... 222/96
4,223,809 A * 9/1980 Martin ..... 222/96
4,234,104 A 11/1980 Apuzzo, Jr. et al.
4,258,864 A 3/1981 Karamanolis et al.
4,286,732 A * 9/1981 James et al. ..... 222/46
4,529,106 A * 7/1985 Broadfoot et al. ..... 222/207
4,548,337 A * 10/1985 Morris ..... 222/96
D335,991 S 6/1993 Roberts et al.
D363,847 S 11/1995 Young
5,868,282 A 2/1999 Imhoff
6,318,596 B1 11/2001 Wiesner
2001/0050290 A1 12/2001 Sampson et al.

* cited by examiner

*Primary Examiner*—Frederick C. Nicolas

(57) ABSTRACT

A toothpaste tube squeezing mechanism includes a housing in which a toothpaste tube is stored and a button which is pushed to dispense toothpaste from the tube. The button is connected to a tube squeezing mechanism by a gear system.

5 Claims, 4 Drawing Sheets

MULTIPURPOSE TOOTH PASTE DISPENSER

TECHNICAL FIELD OF THE INVENTION

The present invention relates to the general art of dispensing, and to the particular field of mechanisms for dispensing material, such as toothpaste, from a tube.

TITLE OF THE INVENTION

Toothpaste for consumer use has long been sold in tubes requiring the user to squeeze part of the tube to extract the paste from a spout at one end of the tube. For many years, the tubes in which the toothpaste was distributed were fabricated from a malleable metal thereby permitting the user to readily extract the paste. In order to efficiently extract the maximum amount of paste from the tube, the user needed to progressively squeeze the tube from the bottom of the tube to the tube spout. As the tube was squeezed from the bottom, the metal tube could be rolled toward the tube spout, thereby effectively preventing the paste from being redistributed to the bottom of the tube should the user squeeze at a midpoint of the tube.

This process works fairly well; however, hand squeezing of such tubes to discharge the required quantity of the tube's contents often results in a badly twisted messed up partly full tube always lying in full view on top of bathroom equipment, thus spoiling the general appearance and neatness of the room. Furthermore, in many cases, the squeezing of the tube is done by careless adults or children, so that a great deal of the tube's contents is lost when the tube is discarded. Still further, it is not uncommon for children to neglect to replace the cap on a toothpaste, thus sometimes allowing the toothpaste to leak out and more often allowing the toothpaste to dry out in the tube neck. Furthermore, children have a tendency not to squeeze the tube from the end opposite the mouth, and the result is wasted toothpaste. Leakage can also result from this type of squeezing because creases tend to turn up in parts of the tube that still contain toothpaste.

The inventor has found that toothpaste tubes often become badly twisted which may cause a cracking of the tube wall thus resulting in loss of the product through the cracks when the tube is squeezed. It is not uncommon to find unsightly partially-squeezed tubes of toothpaste in bathrooms. Oftentimes, these partially-squeezed tubes are found on the bathroom counter, giving the bathroom a cluttered or messy appearance. In addition, it has been observed that a twisted tube cannot be squeezed sufficiently so as to completely expel the contents thereof thus resulting in the tube being discarded prior to complete evacuation.

Another concern with hand-squeezed toothpaste tubes is that the amount of toothpaste administered at each brushing is inconsistent. At times too much toothpaste is squeezed from the tube and administered to the toothbrush. At other times, and particularly with children, too little toothpaste is administered to the toothbrush. Furthermore, the time actually spent brushing varies from brushing to brushing and may often be less than the dentist-recommended time.

Yet another problem with hand-squeezing of toothpaste tubes is that as they are emptied, it becomes increasingly difficult to dispense toothpaste, and nine out of ten times the tube is discarded before all of the toothpaste is used. Both the over-administration of toothpaste and the difficulty of emptying the tube of toothpaste results in toothpaste being wasted.

It is also common that the toothpaste tube is shared by more than one member of a family. In the event that a toothpaste tube is shared by more than one person, hygiene considerations take effect as the toothpaste tube can spread germs from sick family members. Some people consider toiletry items, such as toothpaste tubes and toothbrushes, personal and instead of sharing a single toothpaste tube, several toothpaste tubes for each member of the family may necessarily be stored in the bathroom creating additional clutter and storage problems.

Still further, in recent years, the malleable metal tubes have been replaced by tubes fabricated from plastics materials. The new plastic tubes are still squeezable by the user to extract paste from the tube. However, the plastic material used in the new tubes tends to return to its original shape after it is deformed, thereby essentially making it impossible for the user to roll the bottom of the tube to prevent the paste from being redistributed thereto should the user squeeze at a midpoint of the tube.

Accordingly, there is a need for a toothpaste dispensing system which is capable of efficiently utilizing the toothpaste in the tube, preventing waste, and consistently administering toothpaste from brushing to brushing. What is also needed is a toothpaste system which is able to indicate the correct brushing time. What is further needed is a toothpaste dispensing system which requires minimal physical handling. Such a toothpaste dispensing system should be aesthetically pleasing, hygienic and practical in use.

Furthermore, it is very annoying to reach for the tube of toothpaste and then find that it is not in its usual spot. Therefore, there is a need for a means for storing a toothpaste tube in a readily accessible location that remains constant so that everyone will know where the toothpaste tube is.

The inventor is aware of several mechanical dispensers which can be used to dispense toothpaste. However, these dispensers require the squeezing member to travel along the length of the screw first to dispense product from a container and then reverse its direction along the screw without any work performed other than to return the squeezing member back to its origin. This requires unproductive time on the part of the user to reconfigure the dispenser for subsequent use. Further, this type of mechanism is inefficient and causes undue fatigue upon a user's fingers with manually actuated product dispensers and undue stress upon mechanical and electrical parts in an automatically actuated product dispenser, leading to accelerated mechanical and/or electrical failure of prior art product dispensers. In addition, these dispensers are generally complex in order to accommodate both forward and reverse travel of the squeezing member retained within the frame. These product dispensers have many moving parts and are not economical to manufacture or repair. Furthermore, these dispensers tend to be inconsistent in the amount of product dispensed. These dispensers are often cumbersome to use thereby making them difficult to use by small children or others who may have difficulty in coordinating the use of their hands.

SUMMARY OF THE INVENTION

The above-discussed disadvantages of the prior art are overcome by a dispensing mechanism that includes a gear system which moves a tube squeezer unit incrementally each time a button is pushed. The gear system includes a rack and pinion type unit which is connected by an interlock gear unit to a chain. A tube squeezing unit is mounted on the chain and contacts the tube to be squeezed. The chain rotates as the button is pushed and product is dispensed from the tube.

Using the embodying the present invention will permit all of the toothpaste from a tube to be used and at measured quantities. An aesthetically pleasing housing will contain the tube and the mechanism so that unsightly, partially used, twisted toothpaste tubes will not be left on a surface. Toothpaste can be dispensed without requiring the tube nozzle to touch a toothbrush thereby maintaining a sanitary condition which is not likely to pass germs from one person to another if there are multiple users.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Referring to the figures, it can be understood that the present invention is embodied in a toothpaste tube squeezing mechanism 10.

Figure 1:
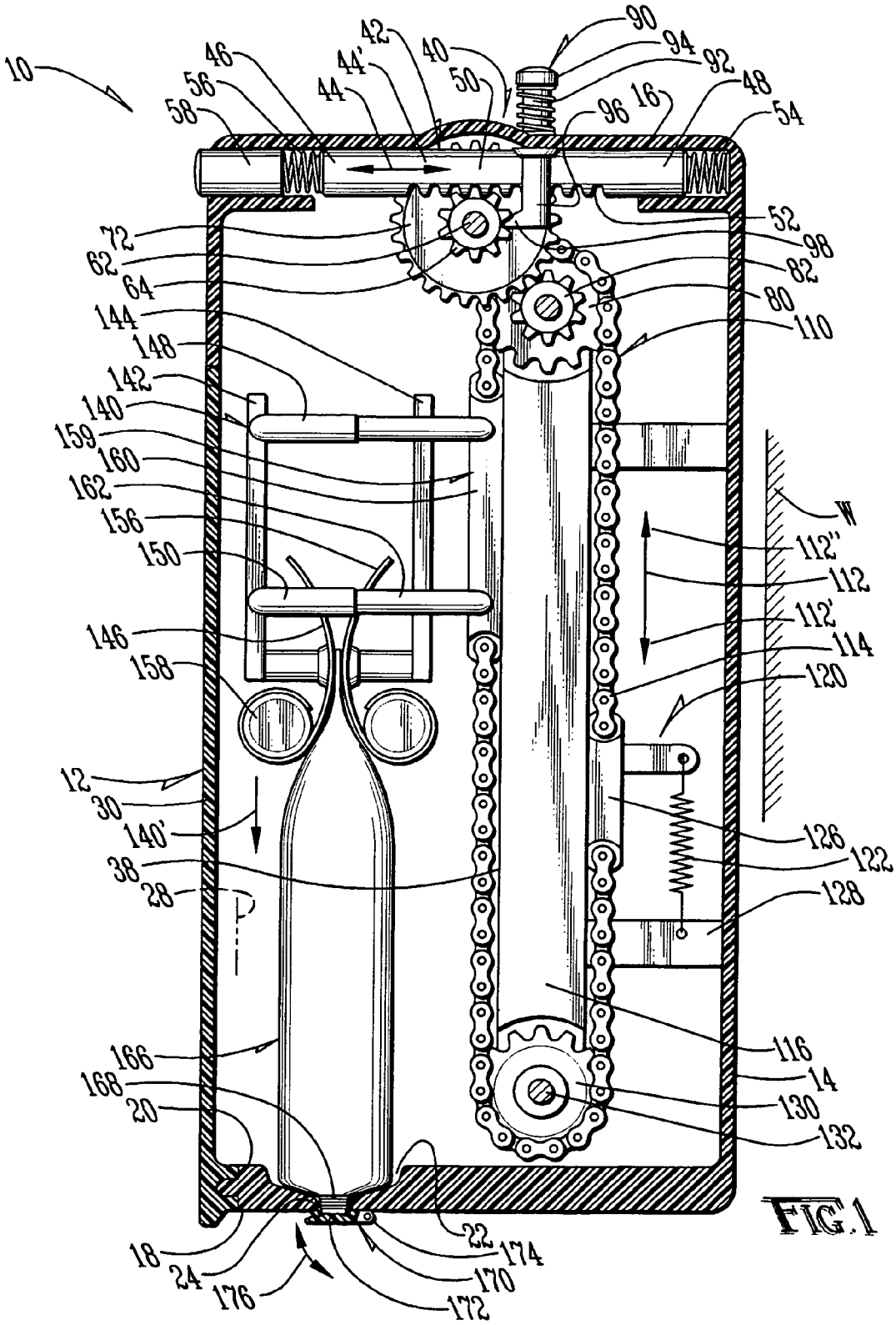
FIG. 1 is a cut away side view of a toothpaste tube squeezing mechanism embodying the present invention.
Figure 2:
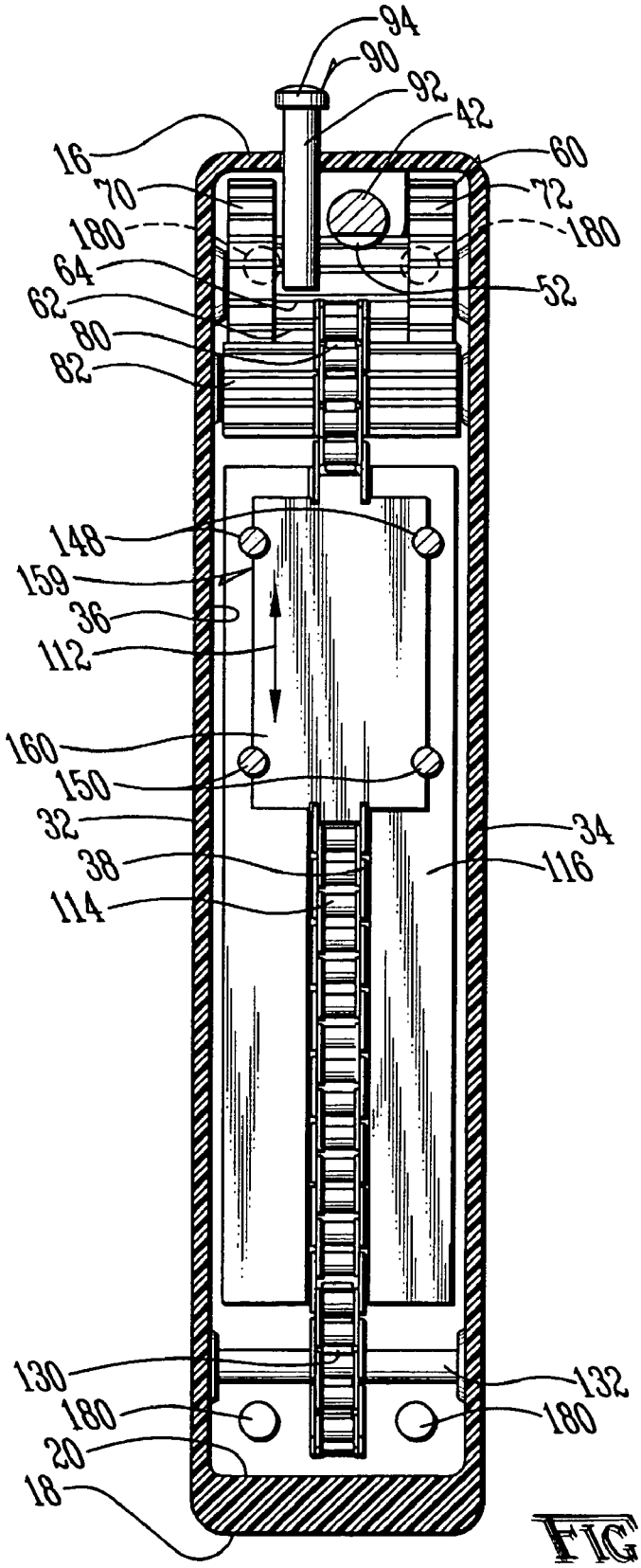
FIG. 2 is a cut away front view of a toothpaste tube squeezing mechanism embodying the present invention.

Mechanism 10 comprises a hollow housing 12 which includes a first wall 14 that is a rear wall when the housing is in a use orientation and which can be mounted on a support surface, such as a wall W or the like when the mechanism is in use. Housing 12 further includes a second wall 16 which is a top wall when the housing is in a use orientation such as shown in FIG. 1 and a third wall 18 which is a bottom wall when the housing is in a use orientation. The bottom wall has a first surface 20 which is an inside surface when the housing is in a use orientation, an indentation 22 in the inside surface and a dispensing hole 24 defined therethrough at the indentation. The use of the indentation and dispensing hole will be understood from the following description.

Housing 12 further includes a longitudinal axis 28 which extends between the top wall and the bottom wall, a fourth wall 30 which is a front wall when the housing is in a use orientation and two side walls 32 and 34. Each side wall has an inner surface 36 with a groove 38 defined therein. The groove extends in the direction of the longitudinal axis and will serve a function that will be understood from the following disclosure.

A drive control mechanism 40 is mounted on the housing adjacent to the top wall and includes a shaft 42 which extends through the front wall toward the rear wall and which is movable toward the rear wall, the shaft can also move away from the rear wall, and shaft movement is indicated by double-headed arrow 44. Shaft 42 has a first end 46 located near the front wall and which extends partially out of the front wall, a rear end 48 which is located near the rear wall and a body 50 which has a plurality of gear teeth 52 defined thereon.

A return spring 54 is interposed between the rear end of the shaft and the rear wall and biases the shaft toward the front wall. A second return spring 56 is located on the first end of the shaft and an operating button 58 is connected to the front end of the shaft.

Shaft 42 is moved toward the rear wall of the housing by pressing on the operating button 58 toward the rear wall of the housing. Operation of shaft 42 in this manner will operate mechanism 10 as will be understood from the teaching of the following disclosure.

Figure 3:
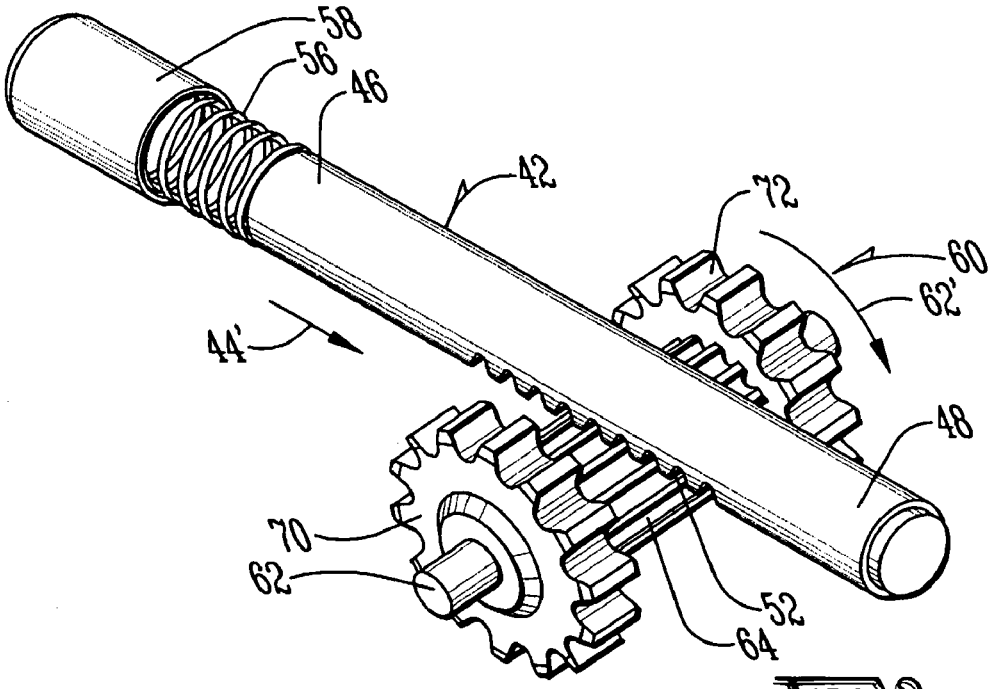
FIG. 3 is a perspective view of an interlocking gear unit included in the mechanism embodying the present invention.
Figure 4:
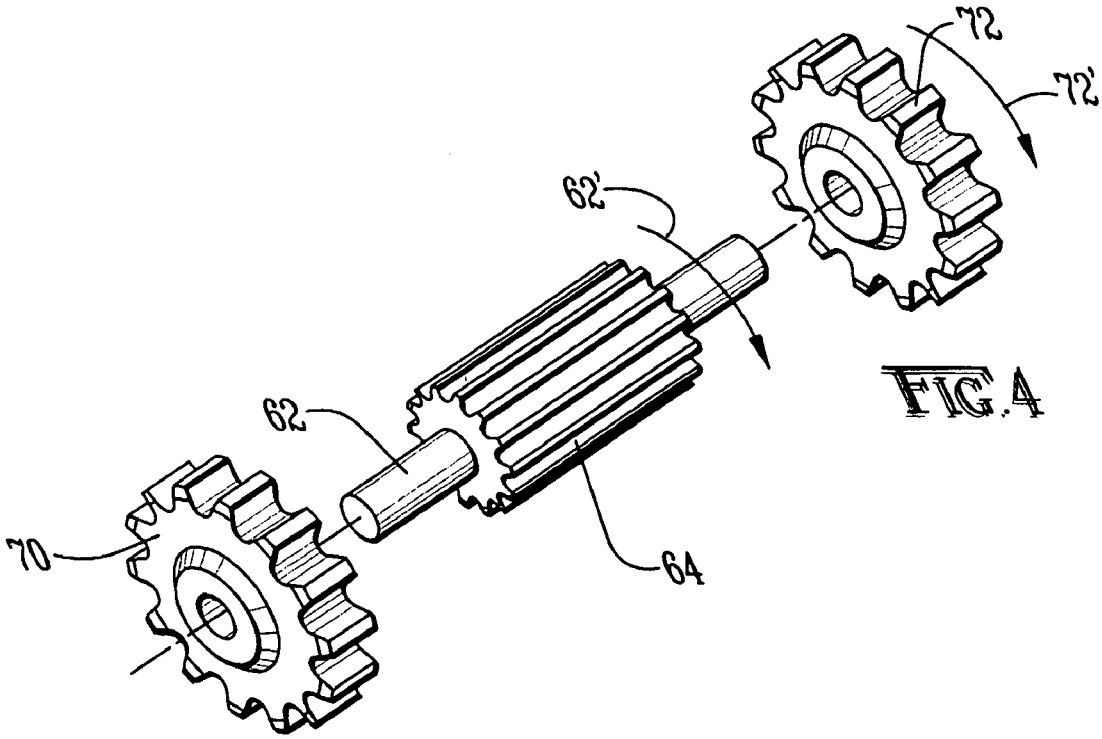
FIG. 4 is an exploded perspective view of a portion of the interlocking gear unit shown in FIG. 3.

An interlocking gear unit 60 is mounted on the housing to mesh with gear teeth 52 on the shaft to be rotated when shaft 42 moves toward the rear wall. Interlocking gear unit 60 includes an axle 62 having gear teeth 64 that mesh with gear teeth 52 on the shaft as shown in FIG. 3. Axle 62 is mounted on the housing to rotate when the shaft is moved toward the rear wall of the housing.

Two primary drive gears 70 and 72 are mounted on axle 64 of the interlocking gear unit for rotation therewith. A secondary power gear 80 is mounted on the housing for rotation. Secondary power gear 80 is mounted on an axle 82 and is located to mesh with one of the primary drive gears to be rotated when the primary drive gear is rotated by rotation of the primary drive gear under the influence of the axle 62 being moved by movement of shaft 42.

A lock release mechanism 90 is mounted on the housing and controls movement of the interlocking gear unit so that the gears will rotate in one direction when shaft 42 is pressed toward the rear wall of the housing, but will prevent reverse rotation of the gears when the shaft is released, but remains biased by spring 54.

Figure 5:
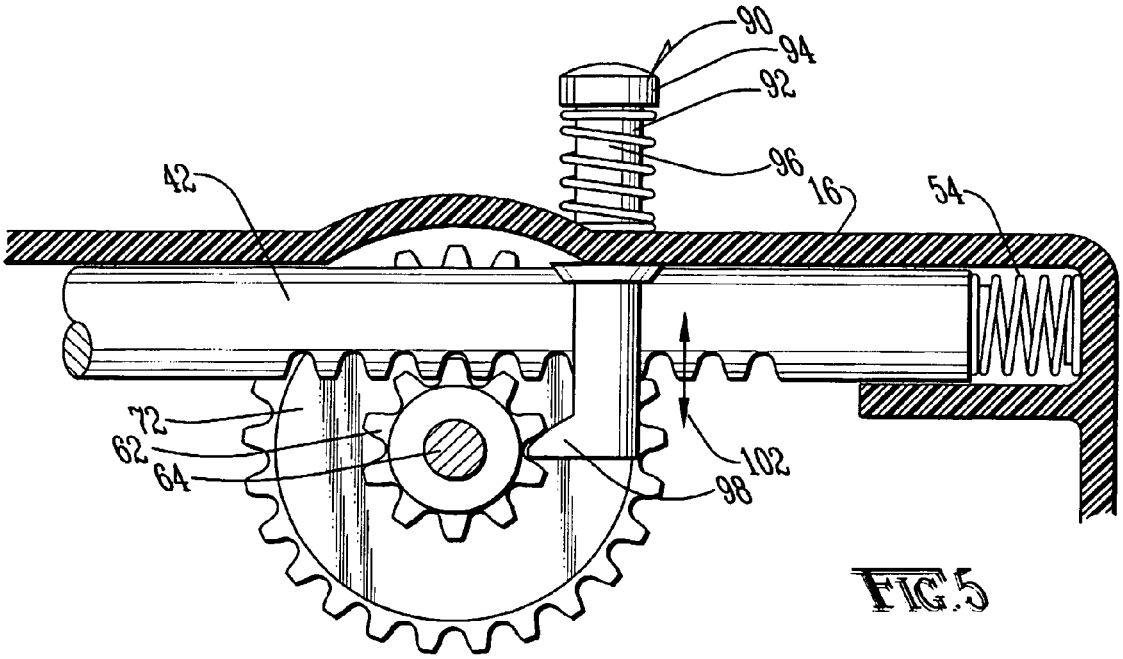
FIG. 5 is shows a lock release mechanism included in the mechanism embodying the present invention.
Figure 6:
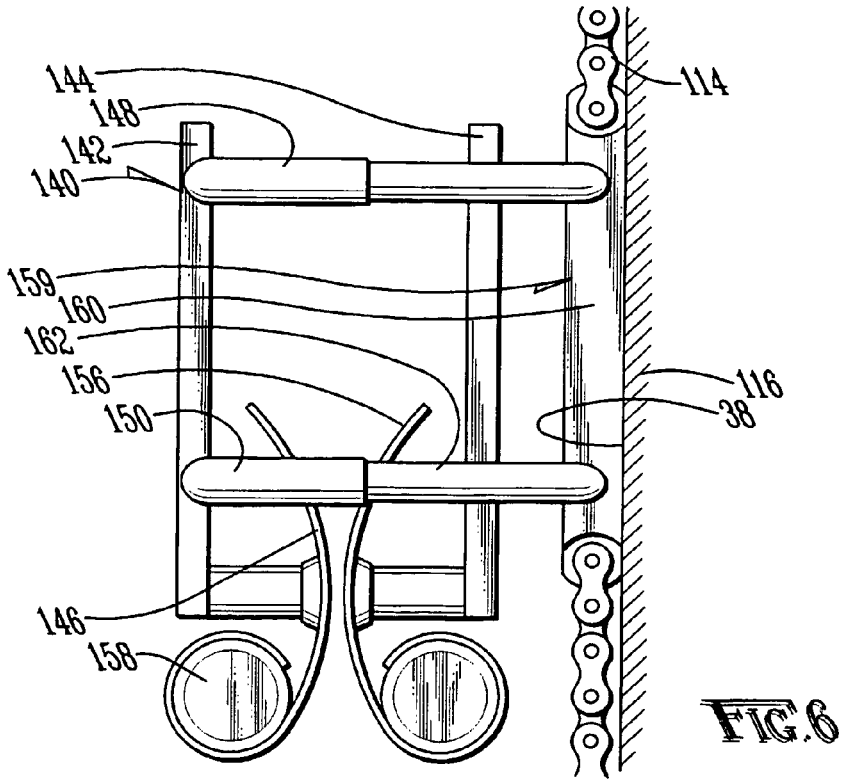
FIG. 6 shows a tube squeezing unit included in the mechanism embodying the present invention.

Lock release mechanism 90 is best shown in FIG. 5 and includes an elongate element 92 which has a head 94 that is located outside the housing adjacent to the top wall and a distal end 96 that is located adjacent to the primary drive gear. The head is accessible from outside the housing to operate the release mechanism.

A biasing element 98 is mounted on the distal end, and a primary drive gear engaging element 100 is mounted on the distal end of the biasing element. The biasing element biases the primary drive gear engaging element away from distal end 96. Primary drive gear engaging element 100 is knife shaped to permit the primary drive gear to rotate in one direction when the primary drive gear engaging element is engaged with the primary drive gear but to prevent rotation of the primary drive gear in an opposite direction when the primary drive gear engaging element is engaged with the primary drive gear.

As indicated by double-headed arrow 102, elongate element 92 is mounted for movement toward and away from the primary drive gear whereby the elongate element can be moved away from the primary drive gear to disengage the primary drive gear engaging element from the drive gear to permit rotation of the primary drive gear in the direction opposite to the direction of rotation of the primary drive gear under the influence of the interlocking gear unit. The elongate element 92 may be operated by a return spring around 96 and situated between 94 and 100. This will allow mechanism 10 to be reset as will be understood from the teaching of the following disclosure.

A chain drive unit 110 is mounted on the housing to move in the direction of the longitudinal axis as indicated by double-headed arrow 112. Chain drive unit 110 includes a chain element 114 which is meshed with secondary power gear 80 to be moved thereby when the secondary power gear is rotated as described above.

Chain element 114 is supported on a chain support 116 mounted on the housing. A chain return unit 120 is mounted on the housing and includes a return spring 122 connected to the chain and biasing the chain in a direction 112' which is opposite to direction 112" which is the direction of movement of the chain under the influence of the secondary power gear. Spring 122 is connected at one end thereof to chain element 114 by a plate 126 and at a second end thereof to a mounting element 128 which is fixedly mounted on the housing.

An idler gear 130 is mounted by an axle 132 on the chain support in a location that is spaced apart from the secondary power gear. Chain element 114 is trained over the idler gear to be guided thereby, and has appropriate gear engaging elements thereon.

A tube squeezing unit 140 is mounted on the housing and includes two pressure plates 142 and 144 mounted on chain 114 for movement therewith. The pressure plates have elements, such as rod 146 having balls on a distal end thereof, that slidably engage grooves 38 defined in the inner surfaces of the side walls for smooth guidance and are spaced apart from each other.

Two tensioning elements 148 and 150 are connecting the pressure plates together and bias the pressure plates toward each other.

A contact plate, such as contact plate 156, is mounted on each pressure plat and bars, such as bars 158, can be mounted to engage the tube if desired. The bars 158 can be small needle bearings.

Tube squeezing unit 140 is mounted on the chain element by a mounting unit 158 that includes a base 160 and two arms, such as arm 162.

Means, such as a support frame mounted on the housing supports a tube 166 in place between the contact plates and adjacent to the chain with a dispensing port 168 of the tube accommodated in dispensing hole 24 of the bottom wall of the housing.

As can be understood from the teaching of this disclosure, the pressure plates press the tube and squeeze the tube to force product, such as toothpaste, contained in the tube out of the dispensing port when the chain is moved via the secondary power gear and the primary drive gear and the interlocking gear and the shaft of the drive control mechanism when the shaft of the drive control mechanism is moved toward the rear wall of the housing.

A cover unit 170 is located on the housing adjacent to the dispensing hole. The cover unit includes a cover element 172 hingeably mounted on the housing and an over-center element 174 which biases the cover element toward the dispensing hole when the cover has moved into a preset orientation. The cover element is moved away from the dispensing hole covering position shown in FIG. 1 to expose the dispensing portion of the tube for use, and is then moved back into the dispensing hole covering position after the product has been dispensed. Movement of the cover is indicated by double-headed arrow 176.

Elements, such as dowels 180, or the like, can be used to mount the housing to the wall W. Those skilled in the art will understand that other mounting elements can be used without departing from the scope of the present disclosure.

As can be understood from the foregoing disclosure, movement of shaft 42 in direction 44' will rotate axle 62 in direction 62' via the meshed engagement of gears 63 and 52. Movement of axle 62 in direction 62' will cause primary gears 70 and 72 to rotate in direction 72'. Rotation of primary gears 70 and 72 in direction 72' will cause secondary gear 80 to rotate in direction 80' due to the meshed engagement between those gears and the primary gears. Movement of the secondary gear in direction 80' will cause movement of the chain element in direction 112" which will cause tube squeezing unit 140 to move in direction 140' toward the bottom wall of the housing. Movement of unit 140 in direction 140' will squeeze tube 166 because the tube is stationary with respect to the squeezing unit. Such squeezing will force product from the tube out of dispensing port 168. If a toothbrush is located beneath port 168, the product, such as toothpaste, will move onto the toothbrush. The lock release mechanism 90 will allow chain movement in direction 112", but will prevent reverse chain movement due to the jamming effect of the element 100 in the associated gear. Thus, once shaft 42 is forced toward the rear wall, the chain will move in direction 112", but upon release of the shaft, return spring 54 will return the shaft into the ready-for-use position shown in FIG. 1 while the element 100 rides over the associated gears. This action will cause the tube squeezing unit to continue to move in direction 112" until all of the product contained in tube 166 is exhausted.

Once the product in tube 166 is exhausted, the housing can be opened by moving front wall 30 and grasping tube 166 and removing it from the housing. The tube squeezing unit can be returned to the initial position shown in FIG. 1 by releasing lock release mechanism 90 by pulling shaft element 92 upward to disengage element 100 from the associated gear which will allow the return spring 120 to move the chain element in direction 112' thereby moving tube squeezing unit 140 from adjacent to bottom wall 18 to the position shown in FIG. 1. Once the squeezing unit is in its initial position, the lock unit can be returned to its gear locking position.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A toothpaste tube squeezing mechanism comprising:

A) a hollow housing which includes (1) a first wall that is a rear wall when the housing is in a use orientation, (2) a second wall which is a top wall when the housing is in said use orientation, (3) a third wall which is a bottom wall when the housing is in said use orientation, the bottom wall having a first surface which is an inside surface when the housing is in said use orientation, an indentation in the inside surface and a dispensing hole defined therethrough at the indentation, (4) a longitudinal axis which extends between the top wall and the bottom wall, (5) a fourth wall which is a front wall when the housing is in said use orientation, (6) two side walls, each side wall having an inner surface with a groove defined therein, the groove extending in a direction of the longitudinal axis;

B) a drive control mechanism mounted on the housing adjacent to the top wall and including (1) a shaft which extends through the front wall toward the rear wall and which is movable toward the rear wall and which has (a) a first end located near the front wall and which extends partially out of the front wall, (b) a rear end which is located near the rear wall, and (c) a body which has a plurality of gear teeth defined thereon, and (2) a return spring interposed between the rear end of the shaft and the rear wall and which biases the shaft toward the front wall;

C) an interlocking gear unit mounted on the housing to mesh with the gear teeth on the shaft to be rotated when the shaft moves toward the rear wall, the interlocking gear unit including an axle having gear teeth that mesh with the gear teeth on the shaft, the axle being mounted on the housing to rotate when the shaft is moved toward the rear wall of the housing;

D) a primary drive gear mounted on the axle of the interlocking gear unit for rotation therewith;

E) a secondary power gear mounted on the housing for rotation, the secondary power gear being meshed with the primary drive gear to be rotated when the primary drive gear is rotated;

F) a lock release mechanism mounted on the housing and which includes (1) an elongate element having a head that is located outside the housing adjacent to the top wall and a distal end that is located adjacent to the primary drive gear, (2) a biasing element on the distal end, (3) a primary drive gear engaging element on the biasing element, the biasing element biasing the primary drive gear engaging element away from the distal end, the primary drive gear engaging element being knife shaped to permit the primary drive gear to rotate in one direction when the primary drive gear engaging element is engaged with the primary drive gear but to prevent rotation of the primary drive gear in an opposite direction when the primary drive gear engaging element is engaged with the primary drive gear, (4) the elongate element being mounted for movement toward and away from the primary drive gear whereby the elongate element can be moved away from the primary drive gear to disengage the primary drive gear engaging element from the drive gear to permit rotation of the primary drive gear in the opposite direction to the direction of rotation of the primary drive gear under an influence of the interlocking gear unit;

G) a chain drive unit mounted on the housing to move in the direction of the longitudinal axis, the chain drive unit including (1) a chain element which is meshed with the secondary power gear to be moved thereby when the secondary power gear is rotated, (2) a chain support mounted on the housing, (3) a chain return unit mounted on the housing and including a return spring connected to the chain element and biasing the chain element in a direction opposite to the direction of movement of the chain element under the influence of the secondary power gear, and (4) an idler gear mounted on the chain support in a location that is spaced apart from the secondary power gear, the chain element being trained over the idler gear; and H) a tube squeezing unit mounted on the housing and including (1) two pressure plates mounted on the chain element for movement therewith, the pressure plates having elements that slidably engage the grooves defined in the inner surfaces of the side walls and being spaced apart from each other, (2) two tensioning elements connecting the pressure plates together and biasing the pressure plates toward each other, (3) a contact plate mounted on each pressure plate, (4) means for supporting a tube in place between the contact plates and adjacent to the chain element with a dispensing port of the tube being accommodated in the dispensing hole of the bottom wall of the housing, and (5) the pressure plates pressing the tube and squeezing the tube to force product contained in the tube out of the dispensing port when the chain element is moved via the secondary power gear and the primary drive gear and the interlocking gear and the shaft of the drive control mechanism when the shaft of the drive control mechanism is moved toward the rear wall of the housing.

2. The toothpaste tube squeezing mechanism defined in claim 1 further including elements on the housing for mounting the housing on a support.

3. The toothpaste tube squeezing mechanism defined in claim 1 wherein the drive control mechanism includes a second return spring which is located on the first end of the shaft.

4. The toothpaste tube squeezing mechanism defined in claim 1 further including a cover unit on the housing adjacent to the dispensing hole, the cover unit including a cover element hingeably mounted on the housing and an over-center element which biases the cover element toward the dispensing hole when the cover has moved into a preset orientation.

5. The toothpaste tube squeezing mechanism defined in claim 1 wherein there are two primary drive gears mounted on the axle of the interlocking gear unit for rotation therewith.

* * * * *